United States Patent [19]
Finley et al.
[11] 4,194,262
[45] Mar. 25, 1980

[54] VACUUM EXTRACTION CLEANING MACHINE

[75] Inventors: Bill G. Finley, Bradford; Terry L. Finley, Jonesboro, both of Ark.

[73] Assignee: Rug Specialist Inc., Jonesboro, Ark.

[21] Appl. No.: 947,243

[22] Filed: Sep. 29, 1978

[51] Int. Cl.[2] ..... A47L 5/38
[52] U.S. Cl. ..... 15/314; 15/321; 15/322; 15/339; 15/352; 15/353; 55/432
[58] Field of Search ..... 15/314, 321, 322, 352, 15/353, 302; 55/432

[56] References Cited

U.S. PATENT DOCUMENTS

| | | | |
|---|---|---|---|
| 3,173,164 | 3/1965 | Congdon | 15/314 |
| 3,705,437 | 12/1972 | Rukavina et al. | 15/314 X |
| 3,780,502 | 12/1973 | Dupre et al. | 15/352 X |
| 3,828,390 | 8/1974 | Cater | 15/321 |
| 3,910,781 | 10/1975 | Bryant | 15/314 X |
| 4,036,346 | 7/1977 | Livingston | 15/327 D X |

*Primary Examiner*—Christopher K. Moore
*Attorney, Agent, or Firm*—Stephen D. Carver

[57] ABSTRACT

A vacuum extraction cleaning machine adapted for coin operated applications. The cleaning machine comprises a remote cleaning tool for spraying cleaning solution upon an area to be cleaned and for extracting dirty cleaning solution through vacuum suction. Means located within the machine and coupled to the cleaning tool deliver vacuum and cleaning solution thereto. Used or dirty cleaning solution extracted by the tool is recovered and temporarily stored within a vacuum tank. Structure associated with the vacuum tank will automatically drain same when vacuum ceases at the end of the machine cycle. Injector valve means are provided to mix cleaning chemical with incoming fresh water to yield the necessary cleaning solution, and means are provided for coupling the machine to an external pressurized water source to facilitate operation.

5 Claims, 9 Drawing Figures

VACUUM EXTRACTION CLEANING MACHINE

BACKGROUND OF THE INVENTION

This invention relates to vacuum extraction cleaning machines. More particularly, the instant invention relates to carpet cleaning machines which spray a cleaning solution upon an area to be cleaned and simultaneously vacuum extract dirt and used cleaning solution therefrom.

In the prior art a variety of machines and equipment exists for cleaning carpets and the like by vacuum extraction. For example, machines of this nature generally employ a hand tool which is moved back and forth over an area to be cleaned. The apparatus sprays a cleaning solution on the area to be cleaned, while at the same time vacuum extracting dirty solution and dirt. Lines coupled between the cleaning machine and the hand tool deliver vacuum and spraying solution to the tool. Many different varieties of this basic concept are known in the prior art. For example, the concept is illustrated in the following U.S. Pat. Nos.: 3,496,592; 3,711,891; 3,812,552; 3,896,521; 3,909,197; and 3,436,787.

Prior art carpet cleaning machine typically employ a separate pump for mixing water with concentrated chemical cleaner stored within the machine. Use of such pumps increases cost and complexity, while simultaneously reducing reliability. Moreover, typical prior art extraction cleaning machines normally include a storage area or device for temporarily storing recovered dirt-laden chemical solution. Such holding tanks usually include manually actuable drain means for manual draining at periodic intervals. The use of such apparatus necessitates regular routine maintenance checks, which drive up the overall cost of the system resulting in increased cost ultimately born by the consumer.

SUMMARY OF THE INVENTION

The instant invention comprises a vacuum extracting carpet cleaning machine in which recovered cleaning solution and dirt is temporarily stored within a vacuum tank which automatically empties itself at the end of the cleaning cycle. Moreover, the instant invention comprises means whereby fresh water and chemical cleaning liquid stored within a holding tank are automatically mixed to form the necessary cleaning solution in response to the flow of water. The entire invention is adapted to function by attachment to a typical pressurized source of water, and no internal water pumps are necessary. Construction in this manner avoids the previously discussed disadvantages characteristic of some prior art devises.

A vacuum generating motor is coupled to a vacuum tank which functions as a holding tank for the temporary storage of recovered cleaning solution. A vacuum line extending between the vacuum tank and a remote hand tool delivers vacuum to the tool for extraction of used solution and dirt from the carpet (or other item being cleaned). A flexible door is mounted over a drain opening provided in the vacuum tank, and while vacuum is supplied to the vacuum tank the door will be maintained in sealing engagement with the drain hole, preventing leakage of fluid therefrom. However, at the end of the cleaning cycle when vacuum ceases, forces of gravity will automatically open the door so that the vacuum tank will drain itself thru the drainhole thus exposed. In this manner the owner or operator of the equipment need not periodically drain and/or inspect the vacuum tank.

Injector valve means are employed to automatically, internally mix stored, concentrated cleaning compound with fresh incoming water. The injector valve means is preferably connected via a solenoid valve to an external, pressurized source of water. A line leading from the injector valve means to the concentrated chemical cleaning compound admits concentrate to the injector valve means via a siphoning effect. Cleaning solution is outputted by the injector valve into a hose extending between the injector valve apparatus and the cleaning tool. The preferably electric solenoid valve automatically opens the water path for machine operation in response to a coin operated timer, preferably included to program machine operation cycles. In this manner cleaning solution is mixed from the chemicals stored within the machine automatically in response to the inputting of fresh water.

Thus a broad object of this invention is to provide a carpet cleaning machine of extreme reliability.

A similar object of this invention is to provide a vacuum extraction cleaning machine of the character described which automatically drains its vacuum holding tank at the end of an operating cycle.

Another object of this invention is to provide an extraction cleaning machine of the character described which will obviate the need for a mechanical water pump and the like. It is an important feature of this invention that injector valve means are employed to automatically mix cleaning chemical with incoming fresh water.

Yet another object of this invention is to provide a cleaning machine of the character described which will be ideally suited for automatic coin operated installations.

These and other objects and advantages of this invention, along with features of novelty appurtenant thereto, will appear or become apparent in the course of the following description.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE DRAWINGS

Figure 1:
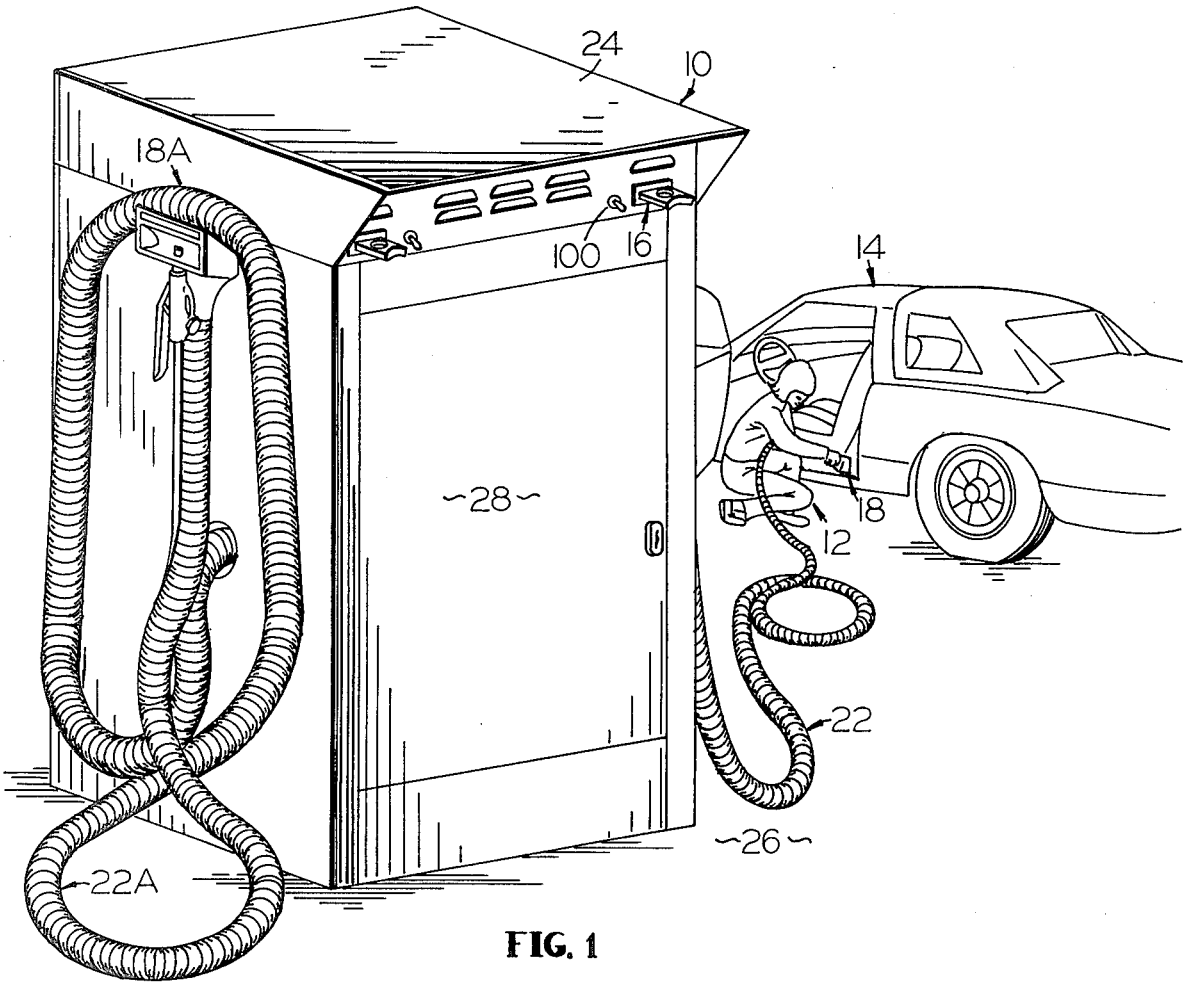
FIG. 1 is a perspective view illustrating the instant invention in operation.

Referring initally to FIG. 1, a vacuum extraction cleaning machine 10 is illustrated in use, wherein a consumer 12 is shown cleaning the upholstery of her automobile 14. In operation the machine is simply actuated by sliding a predetermined number of coins into coin activator 16 which, as hereinafter described, will actuate internal apparatus so that hand tool 18 grasped by the operator 12 will be actuated via connecting cable assembly 22. As will be appreciated from FIG. 1, the extraction machine 10 preferably is housed within a generally cubicle, upright enclosure 24 which is adapted to be disposed upon a supporting surface such as provided by the asphalt 26 or the like. The enclosure 24 preferably includes a front access door 28 which may be opened by the owner of the premises to expose or to service internal machine parts. Machine 10 is actually two machines in one, in that two complete vacuum extraction systems are housed within cabinet 24. Thus an unused cleaning tool 18A, which is linked to machine 10 via cable and hose assembly 22A will be observed in an inoperative position at the left (as viewed in FIG. 1) side of cabinet 24.

Machine 10 utilizes a vacuum extraction cleaning system, the general principles of which are discussed in detail in the aforementioned patents. In short, cleaning of a predetermined surface area is accomplished by simultaneously spraying a cleaning solution at the area while applying vacuum thereto to suck or draw away dirty cleaning solution. To this effect hand tool 18 is preferably of compact dimensions, so that the operator 12 may easily clean the interior of remotely located automobile 14.

Figure 4:
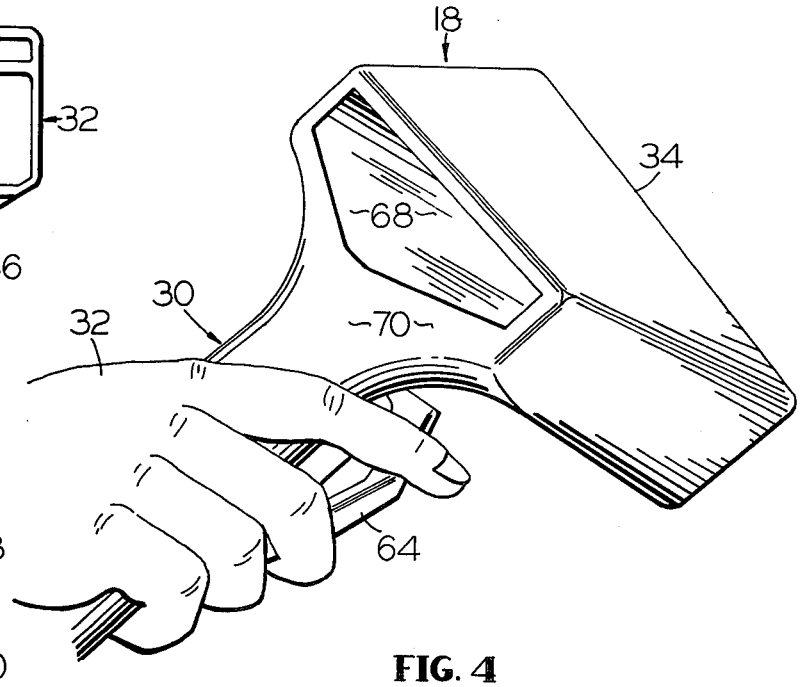
FIG. 4 is a perspective view of the cleaning tool.

Hand tool 18 preferably comprises an elongated neck or handle portion 30 (FIG. 2) which is adapted to be conveniently grasped by the hand 32 (FIG. 4) of the consumer 12. It will be noted that neck portion 30 is preferably integral with a generally cubicle dual chamber lower tool portion 34 which is adapted to physically contact the carpet 36 (or other surface to be cleaned) during the cleaning operation. Tool handle portion 30 is conveniently coupled to cable assembly 22 via a preferably plastic coupling 38. The hose assembly 22 comprises a vacuum hose 40 which extends between coupling 38 and the machine housing 24 and a separate cable assembly 42 which extends the length of hose 40. Assembly 42 comprises a separate line 44 for delivering fluid to the hand tool, a preferably metallic cable 46 which extends between the tool and the interior of the machine housing 24 to prevent theft of tool 18, and an elongated, tubular outer covering 47.

Figure 2:
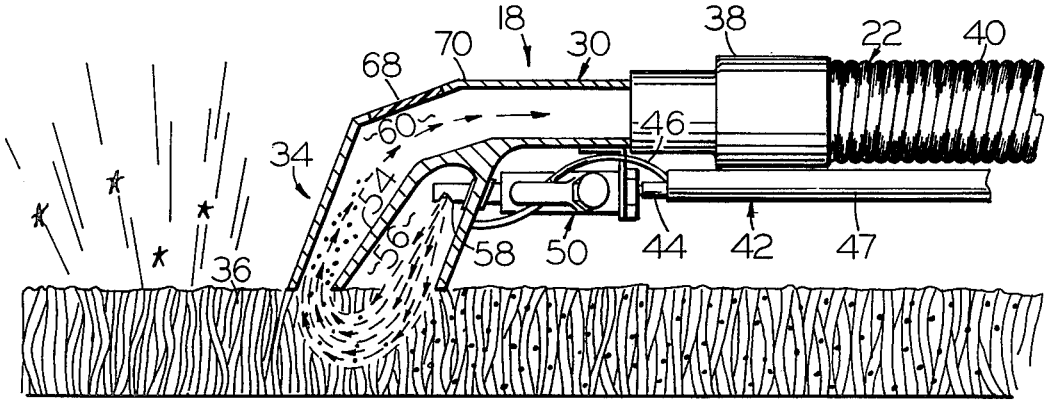
FIG. 2 is an enlarged, sectional, and diagrammatic view showing the preferred cleaning tool associated with the invention.
Figure 3:
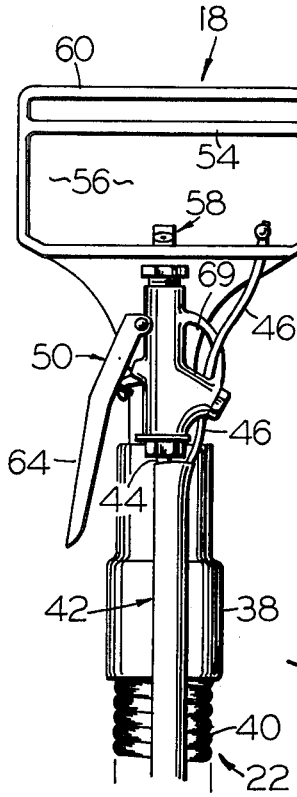
FIG. 3 is a bottom plan view of the cleaning tool shown in FIG. 2.

Tool 18 receives pressurized cleaning solution via hose 44 which terminates in a trigger valve assembly 50. It will be apparent that tool portion 34 is physically divided into two regions via internal partition 54. A first area 56 confines spray directed outwardly from valve nozzle 58 so that sprayed cleaning solution immediately contacts the carpet 36, as illustrated in FIG. 2. The adjacent, separate region 60 is subjected to vacuum by vacuum hose 40, so that used cleaning solution and the dirt carried thereby will be drawn or sucked into the cleaning tool and stored temporarily within the machine 10. As the operator grasps the tool 18, trigger valve handle 64 may be finger operated to actuate the valve mechanism 50 thereby spraying cleaning solution via nozzle 58. When lever 64 is not depressed the tool 18 will simply vacuum the carpet 36. As observed in FIG. 4, a somewhat rectangular, viewing window 68 comprised of translucent material has been provided within the uppermost surface 70 of tool portion 34 to enable the consumer 12 to actually view dirty, recovered cleaning solution whenever the trigger 64 is actuated. As viewed in FIG. 3, safety cable 46 exits from cable assembly 42 and is preferably wound through an aperture 69 and anchored within and through the cleaning tool base 32. Since the cable 46 is preferably comprised of rigid, steel cable, removal or theft of the tool 18 from the machine 10 will be hindered in this manner. The latter feature is extremely important at unsupervised coin operated automobile cleaning installations.

Figure 5:
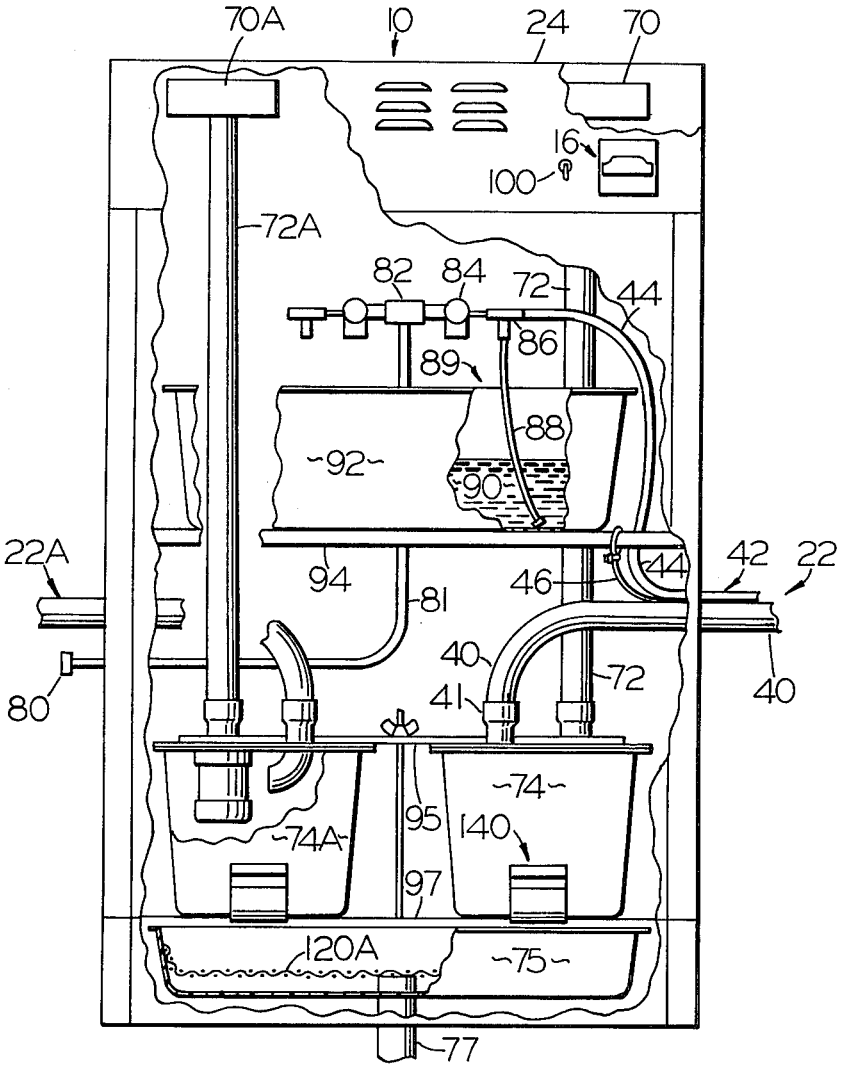
FIG. 5 is a sectional view of the invention with parts thereof broken away for clarity, illustrating internal part placement.

Referring now to FIG. 5, the internal apparatus of the machine 10 will be discussed in detail. For clarity it should be kept in mind that machine 10 is actually two units in one, in that two complete machine cleaning operations are housed within the housing 24. Each side of the machine is capable of operating completely independent of each other, although some internal parts may be shared by the twin cleaning systems.

Vacuum is generated by a conventional vacuum motor 70, and preferably applied through an elongated, vertically positioned tube 72 to a lower vacuum or holding tank 74 which is coupled to the vacuum hose 40 via coupling 41 and vacuum is thus supplied to tool 18 via the vacuum tank. As will be discussed in more detail later in conjunction with FIGS. 7 and 8, the vacuum tank 74 includes suitable baffling apparatus and check valve means whereby dirty or used cleaning fluid drawn into tank 74 via hose 40 is recovered for temporary storage there within, and prevented from being drawn through the tube 72 into the vacuum motor 70. Lower storage tank 75 recovers waste from tanks 74, 74A for draining via pipe 77, as will be discussed later.

An external coupling 80 is provided to connect the machine to an external source of pressurized water. (A separate water pump need not be provided within the present invention). Incoming pressurized fresh water is transmitted through a line 81 to a manifold 82 which directs fresh water to both of the two independent cleaning systems depicted within machine 10. Fresh water is thereafter directed through a preferably electrically-operated solenoid valve 84 into an injection valve 86 whose function is to mix fresh water with concentrated cleaning solution. The injector valve 86 includes a line 88 which leads to a source 89 of concentrated cleaning solution 90. In particular, it will be observed that siphon line 88 terminates within the concentrated cleaning solution 90 stored within tank 92. Tank 92 is preferably deployed on a supporting frame member 94 extending generally horizontally within the confines of the enclosure 24. As fresh water is forced through the injector valve 86 a process of suction or siphoning draws chemical concentrate 90 into the injector valve via line 88, thereby mixing the desired cleaning solution utilized by the cleaning tool 18 and outputting the cleaning solution via line 44.

Figure 6:
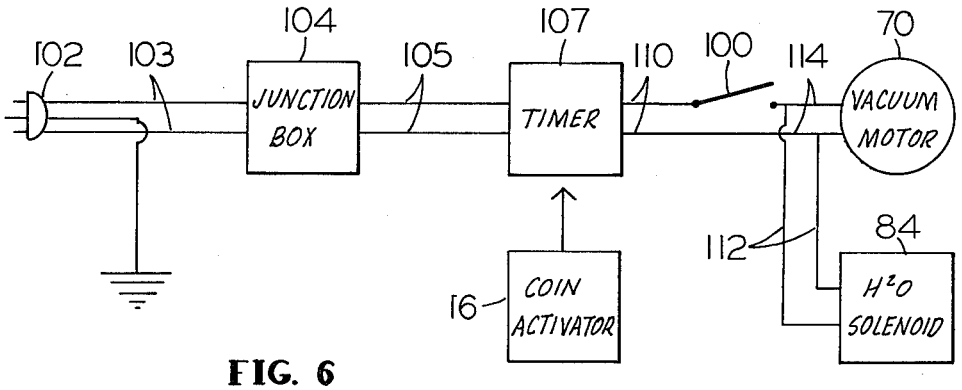
FIG. 6 is a block diagram of the invention electrical system.

In operation the consumer 12 will simply initiate operation by actuating the coin activator 16, and by properly tripping external S.P.S.T. swith 100. As detailed in FIG. 6, machine 10 is adapted to be coupled to an external A.C. power source via a plug 102 which delivers necessary electricity to a junction box 104 via lines 103. A timer 107 similarly receives power from junction box 104 via lines 105, and the machine operation cycle is initiated by the timer when the timer is activated by coin activator 16.

In a normal mode of operation the adjustable timer cycle will be set to approximately 10 minutes. When actuated, timer 107 will apply power across lines 110, thereby actuating the water solenoid 84 via lines 112 and the vacuum motor 70 via lines 114. Switch 100 must normally be closed by the user to make sure that vacuum motor 70 is actuated at the commencement of the timer cycle. Once the vacuum motor has been actuated in this manner, the water solenoid 84 will simultaneously unblock the flow of water to the injector valve means 86, thereby facilitating the spraying of cleaning solution upon the carpet 36.

Figure 7:
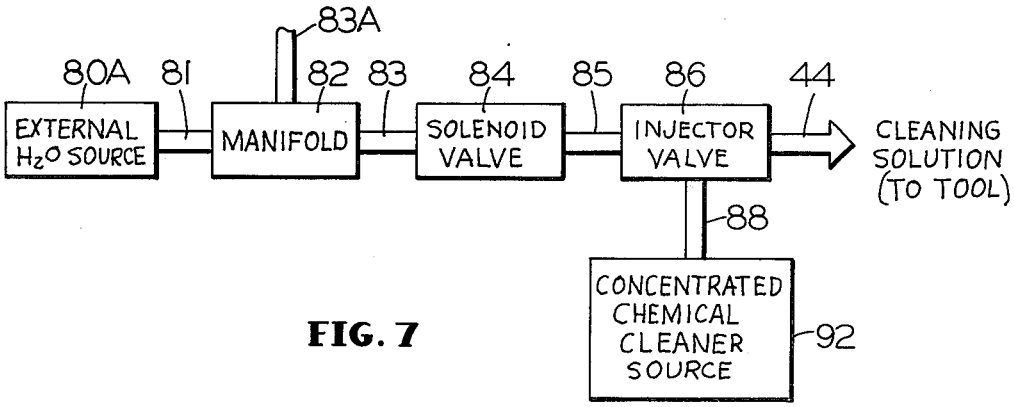
FIG. 7 is a block diagram of the invention water and cleaning solution flow path.

The injector valve system is shown in more detail in FIG. 7, in conjunction with which the cleaning solution mixing system for the right side of the machine 10 will be described. Water from an external water source 80 enters manifold 82 via pipe 81, and flows via line 83 to solenoid valve 84. Pipe 83A delivers water to the left side of the apparatus. When solenoid valve 84 is actuated by timer 107, fresh water under pressure outputted on line 85 will flow through injection valve 86 toward line 44. This flow initiates siphoning through line 88, thereby drawing concentrated chemical cleaner into the injection valve so that a mixing action takes place. In this fashion cleaning solution of the proper concentration will be outputted via line 44 to the cleaning tool 18 as previously discussed. Importantly, the strength of the cleaning solution outputted by the apparatus may be varied by adjusting the standard metering screw system on the injector valve. A suitable injector valve for use in this apparatus is available from Dema Engineering Company of St. Louis, Missouri (model 200-3). A suitable solenoid valve 84 is available from the Dayton Solenoid Company.

Figure 8:
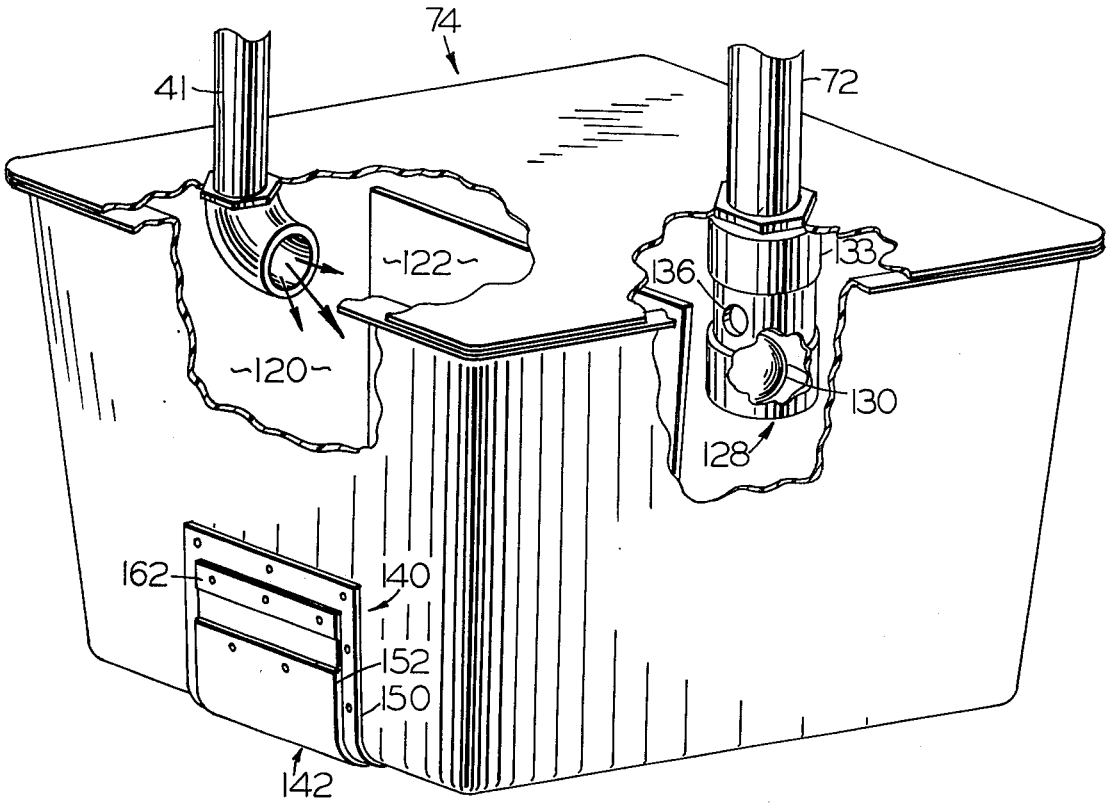
FIG. 8 is an enlarged, perspective view of the vacuum tank employed with the instant invention, with parts thereof broken away or shown in section for clarity.
Figure 9:
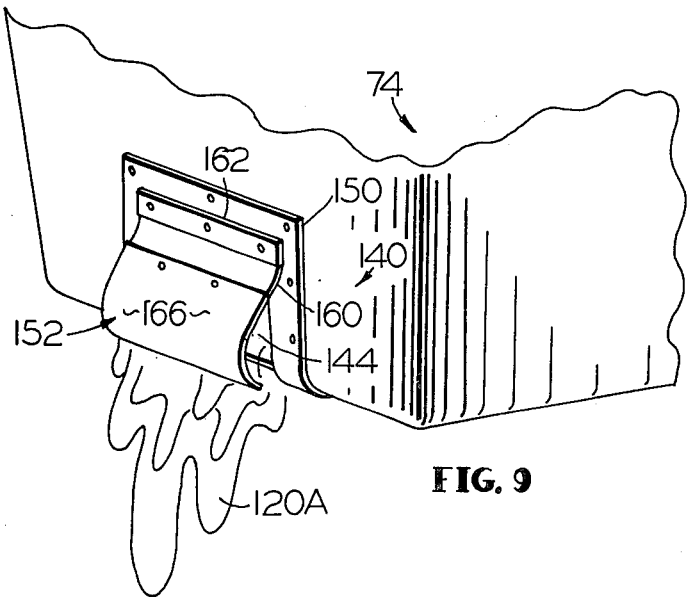
FIG. 9 is a view similar to FIG. 8 but showing the automatic drain system in an open position.

Referring now to FIGS. 5,8, and 9, the vacuum tank and a means for automatically draining the vacuum tank will be discussed in detail. It will be appreciated that while the machine runs through an operation cycle hose 40 will continuously deliver dirty cleaning solution and dirt carried thereby through coupling 41 into the interior of tank 74. Each of the tanks 74 and 74A are rigidly held in place within enclosure 24 between braces 95 and 97. The dirty solution 120 forced into the tank 74 will normally be directed upon a suitable baffle structure 122 so that the liquid carried thereby cannot be drawn into pipe 72 in response to the vacuum supplied by motor 70. In this manner most of the liquid waste 120A will slowly collect and rise within the tank. However, if the liquid level rises too high, a check valve system 128 will prevent admission of liquid into pipe 72 and thus motor 70. In particular, it will be apparent that check valve system 128 comprises a ball or suitable object 130 disposed within a lower cage unit 133 through which air may be drawn through holes 136. The lower orifice of pipe 72 terminating within cage 133 will be blocked by ball 130 when and if it floats upwardly in response to increased liquid level within tank 74. In this manner the tank 74 will remain blocked and inoperative preventing over-fill until the timing cycle runs out, at which time timer 107 will disconnect the vacuum motor 70. When vacuum ceases the vacuum tank will automatically drain, as will now hereinafter be discussed.

The vacuum tank or tanks employed by the instant invention are equipped with means for automatically draining dirty cleaning solution when the operation cycle is completed. In particular, the automatic draining system 140 comprises a blocking system 142 for appropriately occluding or blocking an oriface 144 (FIG. 9) provided within the tank 74 whenever vacuum is applied to the tank.

In a preferred form of the invention the automatic draining system 140 comprises a rigid periphery 150 preferably comprised of metal which is adapted to conform to the edge of the hole 144 defined within tank 74. In particular, it will be observed that the periphery 150 is bent slightly in edgewise profile to conform to the contoured lowermost ridge of the tank 74. A flapper door 152 comprised of resilient rubber, plastic or the like is flexibly suspended operatively adjacent periphery 150 to block orifice 144 whenever vacuum is supplied to the tank 74. It will be observed that when vacuum is supplied to the tank 74 pressure differentials will force flapper door 152 into abutment with the periphery 150 thus shutting the tank. The flapper door 152 preferably comprises a generally rectangular plastic or resilient rubber substance 160 which is flexibly attached or suspended to periphery 150 by an elongated metallic cross piece 162. A longer, curved reinforcement plate 166 is glued or otherwise attached to the portion 160 to conform the flapper door to the outside geometry of the periphery 150 (which is in turn conformed to the geometry of the holder tank 74). In this manner the drain hole 144 will absolutely be sealed when the flapper door 152 is drawn into abutment with the rigid periphery 150 in response to generation of vacuum. Alternatively, when vacuum ceases, it will be apparent that recovered cleaning solution 120A will immediately drop through the passageway 144 when the door swings to an open position automatically in response to its own weight.

In the illustrated embodiment the machine will drain the solution 120A into an optional recovery tank 75 which is positioned below the partition 97 below the tanks 74 and 74A, within enclosure 24. The output of tank 75 is transmitted through pipe 77 which can lead to a sewer or other conventional drain.

From the foregoing, it will be seen that this invention is one adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that the matter herein set forth or shown in the accompanying drawings is to be interpreted as illustrative and not in a limiting sense.

What is claimed is:

1. A vacuum extraction cleaning machine for cleaning upholstery, carpet and the like, said machine comprising:

cleaning tool means for spraying cleaning solution on an area to be cleaned and for vacuum extracting used cleaning solution and dirt thereby cleaning said area;

a pressurized source of cleaning solution, said source comprising:

a tank for containing concentrated chemical cleaner;

injector valve means adapted to be coupled to an external pressurized fresh water source for mixing concentrated cleaning chemical with water thereby outputting said cleaning solution, said injector valve means coupled to said chemical cleaner tank thereby siphoning and diluting chemical cleaner in response to fresh water flow; and solenoid valve means for admitting fresh water into said injector valve means;

flow path means extending between said cleaning solution source and said cleaning tool for delivering cleaning solution to said tool;

means for generating vacuum during operation of said machine said vacuum generating means comprising an electrically driven motor;

vacuum tank means coupled to said vacuum generating means for temporarily storing used cleaning solution extracted be said tool;

hose means extending between said tool and said vacuum tank for supplying vacuum to said tool;

timer means for electrically activating said vacuum generating means and said solenoid valve means for a predetermined time; and means for automatically draining said vacuum tank, said draining means comprising:

an output drain hole defined in said vacuum tank, said hole comprising a rigid periphery; and flapper door means flexibly suspended from said vacuum tank and adapted to sealingly contact said periphery for plugging said drain hole in response to vacuum existing inside said vacuum tank.

2. Vacuum extraction cleaning apparatus comprising:

tool means for treating an area to be cleaned by spraying cleaning solution thereon and vacuum extracting dirty cleaning solution and dirt therefrom;

a source of concentrated chemical cleaner;

water input means adapted to be coupled to an external pressurized source of water;

injector valve means in fluid flow communication with said source of chemical cleaner for siphoning and diluting concentrated chemical cleaner in response to the flow of water thereby outputting said cleaning solution, said injector means having an output;

solenoid valve means in fluid flow communication with said water input means for controllably inputting water to said injector valve means;

a fluid flow path between said injector valve means output and said tool means for delivering cleaning solution to said tool means;

means for generating vacuum;

timer means for actuating said vacuum generating means and said solenoid valve means for a predetermined time;

vacuum tank means coupled to said vacuum generating means for storing at least temporarily used cleaning solution and dirt extracted by said tool;

means coupling said vacuum generating means to said vacuum tank means; and means extending between said vacuum tank means and said tool means for supplying vacuum to said tool means.

3. The combination as defined in claim 2 wherein said vacuum tank means includes means for automatically draining said vacuum tank in response to cessation of vacuum within said vacuum tank.

4. The combination as defined in claim 2 including coin-operated means for actuating said timer means.

5. The combination as defined in claim 2 including ridgid cable means extending between said cleaning apparatus and said tool means for securing said tool means to said cleaning apparatus thereby minimizing the risk of damage from vandalism.

* * * * *